United States Patent [19]

Beasley

[11] 4,393,793

[45] Jul. 19, 1983

[54] TUFTING MACHINE WITH ADJUSTABLE YARN GUIDE TUBE BANK

[75] Inventor: Max M. Beasley, Chattanooga, Tenn.

[73] Assignee: Tuftco Corporation, Chattanooga, Tenn.

[21] Appl. No.: 344,376

[22] Filed: Feb. 1, 1982

[51] Int. Cl.[3] ..... D05C 15/18

[52] U.S. Cl. ..... 112/79 R

[58] Field of Search ..... 112/79 R, 79 A, 302, 112/253

[56] References Cited

U.S. PATENT DOCUMENTS

| | | | |
|---|---|---|---|
| 2,862,465 | 12/1958 | Card | 112/79 A |
| 3,001,388 | 9/1961 | MacCaffray | 112/79 A UX |
| 3,055,196 | 9/1962 | Brunner et al. | 112/79 A X |
| 3,075,482 | 1/1963 | Card | 112/79 A |

*Primary Examiner*—Ronald Feldbaum

*Attorney, Agent, or Firm*—Harrington A. Lackey

[57] ABSTRACT

A bank of yarn guide tubes mounted for vertical adjustment upon the rear portion of a multiple-needle tufting machine for guiding yarns from a yarn supply to the needles, on the fabric delivery side of the machine, and with a minimum of threaded yarn guide elements.

9 Claims, 3 Drawing Figures

TUFTING MACHINE WITH ADJUSTABLE YARN GUIDE TUBE BANK

BACKGROUND OF THE INVENTION

This invention relates to tufting machines, and more particularly to a yarn guide device for a multiple-needle tufting machine.

In a typical multiple-needle machine, the base fabric is fed through the machine in a feeding direction from the front or input side of the machine to the rear, output, or fabric delivery side of the machine. Moreover, the yarn for the needles is fed down through the front or input side of the machine. There have been some specialized multiple-needle tufting machines, particularly of finer gauge, which have included means for feeding the yarn to the needles down both the front and the back of the machine.

In the normal operation of a typical multiple-needle tufting machine having front yarn feed, two operators are utilized. A first operator is stationed in front of the machine for observing the condition of the yarns fed to the needles, and also for controlling the tufting operation, that is the operation of the needles penetrating the base fabric. A second operator, usually referred to as in inspector/mender is stationed at the rear of the machine to observe the tufted fabric and inspect for defects in the face or tufted yarn. When a defect is spotted, the second operator stops the tufting machine and repairs or mends the carpet with a handheld, pistol-type, tufting mending gun. The second operator can also control the carpet re-roll machine which may be stopped and started independently of the tufting machine.

Also, in a typical multiple-needle tufting machine, the yarns are fed down the front face of the tufting machine, toward the needles through a plurality of yarn guides. Each yarn guide is typically an elongated bar perforated or drilled with a plurality of holes, each hole being large enough in diameter to freely receive a yarn. There may be several spaced perforated yarn guides mounted on the front of the machine between the yarn supply or yarn feed rolls and the needle bar. One example of such a yarn guide arrangement is disclosed in the R. T. Card U.S. Pat. No. 3,075,482.

Apertured thread or yarn guides may also be employed to direct the yarn around the yarn feed rolls to provide the proper wrap for the yarns about the surfaces of the feed rolls. Moreover, there is a stationary thread jerker fixed to the machine housing and a movable thread jerker attached to the needle bar, both of which are usually apertured or perforated for receiving individually threaded yarns. A final thread guide is usually fixed to a needle bar adjacent the needles for guiding the threads from the yarn jerkers to the needles. An example of the stationary and movable yarn jerkers and the needle bar thread guide are illustrated in the Card U.S. Pat. No. 3,075,482. Another example of the apertured stationary and movable yarn jerker bars is disclosed in the R. T. Card U.S. Pat. No. 3,442,233.

An example of a plurality of spaced yarn or thread guides on both the front and back face of the tufting machine is disclosed in the Nowicki U.S. Pat. No. 3,396,687.

If each tufting machine is feeding several hundred yarns to corresponding needles through five or six yarn guides, each yarn guide having a guide hole for each yarn, the time required for threading each of the several hundred yarns through all of their respective guide holes becomes excessive.

Yarn guide tubes have been employed to guide yarns from the feed rolls or yarn supply to the needles, but such yarn guide tubes have been mounted on the front face of the machine, and are utilized in unequal lengths to feed yarns in repeat patterns to the needles, as illustrated in the J. L. Card U.S. Pat. No. 2,862,465, issued Dec. 2, 1958. Moreover, these yarn guide tubes previously used are stationarily mounted upon the front face of the tufting machine.

SUMMARY OF THE INVENTION

It is therefore an object of this invention to provide in a multiple-needle tufting machine a yarn guide device which will substantially reduce the time required for threading or re-threading the yarns through the guide elements to the needles, and which will also require only a single operator for the operation of the tufting machine.

More particularly, the yarn guide device made in accordance with this invention incorporates a yarn guide tube bank consisting of a plurality of yarn guide tubes, preferably of equal length and parallel to each other, and including one yarn guide tube for each yarn handled by the tufting machine. The yarn guide tube bank is provided with an adjustable mounting device, such as mounting brackets adjustably supporting the yarn guide tube bank upon the rear face of the tufting machine, instead of the front face, and located in a yarn guiding position between the normal yarn supply or yarn feed rolls and the needle bar supporting the transversely spaced needles. By utilizing the yarn tube bank, several of the conventional transverse apertured yarn guides or thread guides are eliminated. In most instances, where the yarn tube bank is utilized in accordance with this invention, only a single apertured yarn guide is incorporated, and that is the yarn guide fixed to the needle bar for guiding the yarns directly to the needles.

Although a movable thread or yarn jerker is utilized, nevertheless this yarn jerker is preferably in the form of an elongated transverse bar, instead of a perforated plate or flange. The bar may be provided with longitudinally or transversely spaced grooves or recesses for guiding or receiving the yarns, if desired. A stationary yarn jerker is employed in the form of another elongated transverse bar, also preferably having the longitudinally spaced annular grooves or recesses for guiding the individual yarns. In a preferred form of the invention, a stationary yarn jerker rod is mounted upon or fixed to the bottom of the yarn tube bank for guiding the yarns passing through the yarn tubes to the movable jerker.

The adjustable mount for the yarn guide tube bank permits the tube bank to be adjusted vertically so that the lower open ends of the yarns and/or the stationary yarn jerker rod may be positioned the proper distance from the movable yarn jerker rod in order to provide the proper amount of stored yarn for furnishing a predetermined length of yarn to the needle upon its downward stroke to properly form the tufted loop of the desired uniform length in the base fabric.

By mounting the yarn guide tube bank upon the rear of the machine, a single operator stationed at the rear of the machine may control the tufting operation and observe the condition of the face yarns fed to the needles to determine if any of the face yarns are loose, skipped or broken, and therefore require mending. The single operator can simultaneously see the back of the carpet immediately after tufting to locate bad cutting or other defects, usually observed by an inspector. Since only a single operator is required for all these functions, any completed portions of the carpet which have defective surfaces may be marked, transferred to a different station and operated upon separately by a single operator with a mending gun, so that such a mending operator may mend or repair carpets from several different tufting machines.

The elimination of substantial periods of down-time, particularly in threading and rethreading the yarns in the yarn guide elements considerably increases the efficiency of the tufting operation.

DESCRIPTION OF THE PREFERRED EMBODIMENTS

Figure 1:
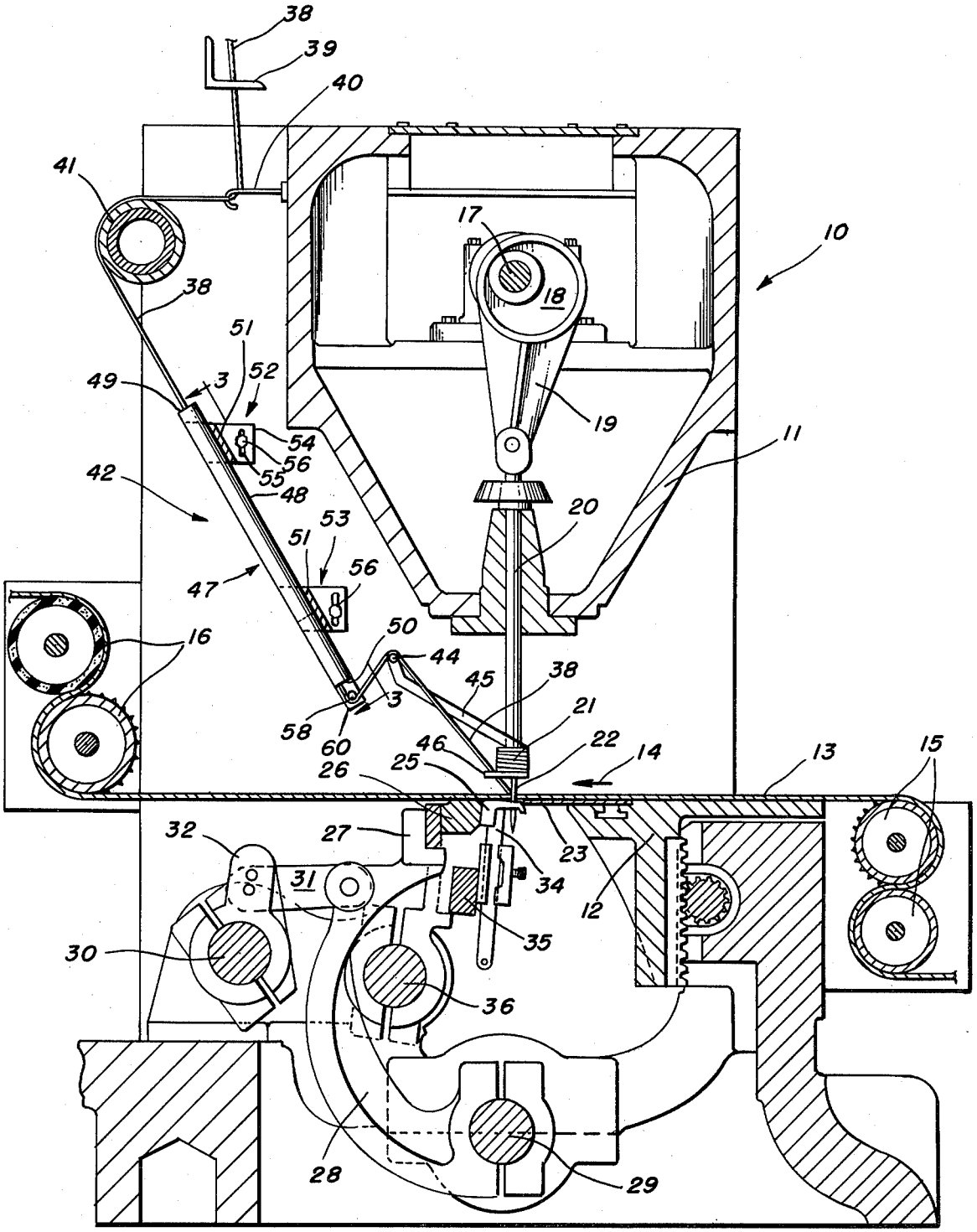
FIG. 1 is a sectional elevation of a multiple-needle cut pile tufting machine having in-line needles, and incorporating the yarn guide device made in accordance with this invention.
Figure 2:
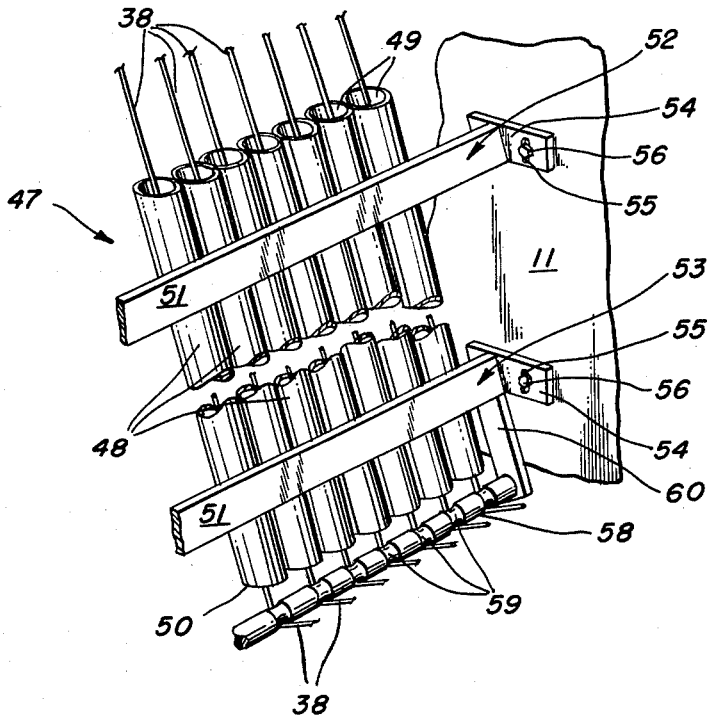
FIG. 2 is an enlarged fragmentary front perspective view of a portion of the yarn guide tube bank, with portions broken away, mounted on the tufting machine.
Figure 3:
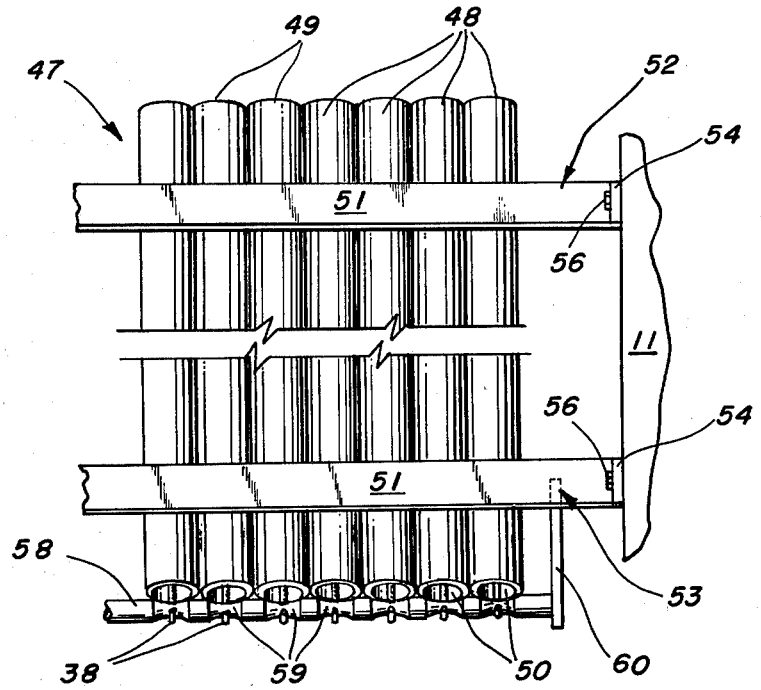
FIG. 3 is an enlarged fragmentary view taken along the line 3—3 of FIG. 1, of the yarn guide tube bank, with portions broken away.

Referring now to the drawings in more detail, FIG. 1 discloses a cross-section of a multiple-needle tufting machine 10 including a frame or housing 11 having a bed plate 12 adapted to support the movement of the base fabric 13 fed through the machine in the direction of the arrow 14 from the front to the rear, by means of fabric feed rolls 15 and 16. The needle drive mechanism may be of any convenient type such as that disclosed in the drawings, or such as a rocker-shaft type needle drive mechanism as disclosed in the U.S. Cobble et al U.S. Pat. No. 2,977,905.

The needle drive mechanism disclosed in FIG. 1 includes a transverse needle shaft 17, extending the full width of the machine, and which may be driven by any suitable power means, not shown. Mounted on the needle shaft 17 at transversely spaced intervals, are a plurality of eccentrics 18, operatively associated with the corresponding connecting rods 19, to vertically reciprocate the push rods 20 to reciprocally drive the needle bar 21 vertically. A plurality of transversely aligned needles 22 are mounted on the needle bar 21 to alternately penetrate the moving base fabric 13.

The slotted needle plate 23, of conventional construction, is mounted on top of the bed plate 12 to support the base fabric 13, while the needles 22 reciprocate therethrough.

Adapted to cooperate with each of the needles 22 below the base fabric 13 is a typical cut pile hook 25, pointing in the direction opposite from the direction of fabric feed, illustrated by directional arrow 14. The cut pile hooks 25 are transversely mounted at a uniform spacing equal to the needle gauge and supported in the hook bar 26. The hook bar 26 is mounted in a plurality of transversely spaced brackets 27, each of which is fixed to the upper end portion of a rocker arm 28, the lower end portion of which is journaled upon the looper shaft 29. The rocker arm 28 is driven from a jack shaft 30 through the link bar 31, pivotally connected at its opposite ends to the rocker arm 28 and the radial crank arm 32. The jack shaft 30 is reciprocally driven by conventional means, not shown.

Cooperating with each of the hooks 25 is a knife 34. The knives 34 are transversely held in uniform spaced relationship by the knife holder 35 in turn fixed to the knife shaft 36. The jack shaft 30 and knife shaft 36 are cooperatively driven with the needle shaft 17 in timed relationship by conventional drive means, not shown. The needles 22 and their cooperating cut pile hooks 25 and knives 34 cooperate in a well-known manner to produce cut pile tufts.

If desired, the needles 22 can cooperate with conventional looper apparatus for forming tufted loops, in a well known manner.

Yarns 38 are fed to the needles 22 from a yarn supply, such as a creel, not shown, passing through a creel terminal 39. Each yarn 38 is then passed around a guide hook 40 and wrapped around the surface of a driven yarn feed roll 41 mounted upon the rear portion of the machine frame 11. The yarn feed mechanism may also consist of two or more conventional driven friction rollers. The yarns 38 are then fed downward through the yarn guide device 42 made in accordance with this invention, where the yarns pass over a movable thread jerker bar or rod 44. The movable jerker bar 44 is supported by arms 45 upon the needle bar 21. The yarns 38 then pass through the apertures or eyes of a conventional yarn guide bar 46 fixed to the bottom rear portion of the needle bar 21 for guiding the yarns 38 to their respective needles 22. The yarns 38 fed to the needles 22 are then carried by the needles 22 through the base fabric 13 for forming loops about the cut pile hooks 25. The loops are then severed by the knives 34 to produce the cut pile tufts.

The yarn guide device 42 made in accordance with this invention comprises a yarn guide tube bank 47 composed of a plurality of straight parallel yarn guide tubes 48 preferably of equal length and having open upper ends 49 and open lower ends 50. The yarn tubes 48 are fixed in a parallel coplanar relationship upon the transverse straps 51 of upper and lower brackets 52 and 53. The straps 51 in each bracket 52 and 53 terminate in forward projecting ears 54 having vertical elongated slots 55 for receiving adjustment bolts 56.

Preferably fixed below the lower open ends 50 of the tubes 48 is an elongated transversely extending stationary yarn jerker rod 58. The jerker rod 58 may be fixed to the yarn guide device 42 in any convenient manner, such as by arm 60 secured to the transverse strap 51 of lower bracket 53, in such a manner that the yarns 38 passing through the open ends 50 may bend across the jerker rod 58 and extend toward and across the movable jerker bar 44. The yarn jerker rod 58 could be welded directly to the front edges of the open lower ends 50 of the yarn tubes 48 if desired.

If desired, a plurality of transversely spaced annular grooves 59 may be formed in the stationary jerker rod 58, in alignment with the corresponding longitudinal axes of the tubes 48 for guiding invididual yarns 38 around the stationary yarn jerker rod 58. In like manner, the movable jerker bar 44 may also be provided with corresponding annular grooves, not shown, for maintaining the individual yarns 38 in alignment with their respective tubes 48 and needles 22.

The tube bank 47 is positioned behind and above the needle bar 21. The upper open end 49 of each of the tubes 48 is in alignment with the path of a corresponding yarn 38 leaving the yarn feed roll 41.

In order to accumulate the appropriate amount of slack in the portions of the yarn 38 between the stationary yarn jerker rod 58 and the needles 22, the bolts 56 may be loosened to permit vertical adjustment of the brackets 52 and 53, and therefore the tube bank 47, so that the stationary yarn jerker rod 58 will be at the appropriate height relative to the yarn jerker bar 44. The length of the yarn portion between the yarn jerker rod 58 and the yarn jerker bar 44 when the needle bar 21 is in its uppermost position, determines the amount of yarn 38 available for the desired height of the tufted loop produced by the penetration of the needles 22 through the base fabric 13.

By mounting the creel terminal 39, guide hooks 40, yarn feed roller 41, yarn guide device 42, movable yarn jerker bar 44, and the yarn guide bar 46, all on the rear portion of the machine 10, as opposed to the conventional mounting of the yarn guide elements on the front of the machine, a single operator may be stationed at the rear of the machine for observing all of the yarn feed operations, the needle tufting operation, and the quality of the completed tufted fabric. Moreover, should the yarns 38 need re-threading, it is only necessary to engage the yarns 38 with their respective guide hooks 40 and wrap the yarns 38 around the surface of the cloth feed roll 41, and then blow the individual yarns 38 through the respective guide tubes 48 from the upper end 49 down through the lower open end 50. The yarns 38 are rapidly threaded through the yarn guide tubes 48 by compressed air projected from a small, conventional, manually-operated air gun.

Since both the stationary yarn jerker rod 58 and the yarn jerker bar 44 have smooth surfaces and do not include apertures for receiving the yarn 38, the yarns 38 are merely passed around the respective yarn jerker rod 58 and bar 44. Then, the yarns 38 are threaded only through the perforations or apertures in the yarn guide bar 46 fixed to the needle bar 21. The yarns 38 are finally threaded, in a conventional manner, through the eyes of the respective needles 22. By utilizing a yarn guide device 42 made in accordance with this invention, substantial down-time is eliminated in threading or re-threading the yarn guide device 42. Only the yarn guide bar 46 and needles 22 are threaded, as in prior art tufting machines, thus eliminating the threading of five or six additional apertured yarn guide bars.

It is also within the scope of this invention to eliminate the stationary yarn jerker rod 58, provided the edges of the open lower ends 50 of the yarn guide tubes 48 are smooth enough to guide the individual yarns 38 with a minimum of wear. The lower edges of the open lower ends 50 will function in the same manner as the stationary yarn jerker rod 58.

Instead of utilizing the recesses or grooves 59, the yarns 38 passing around the stationary yarn jerker rod 58 may be maintained separate from each other by annular flanges or washers, not shown.

The spacing between the rear fabric feed rolls 16 and the yarn guide device 42 should be great enough to permit the operator to easily reach into the rear area of the machine 10 above the fabric 13 to perform the various threading operations, to mark defects in the tufted fabric, and to carry out any other desired operations in the area. In order to maximize such rear spacing, the rotary axes or shafts of the rear fabric feed rolls 16 may be arranged in a plane inclined rearward as shown in FIG. 1. The fabric feed rolls 16 may also be moved further rearward, if desired.

What is claimed is:

1. In a tufting machine having means for supporting a base fabric for longitudinal movement in a feeding direction from front to rear through said machine, a plurality of transversely spaced reciprocal needles for introducing yarns through the base fabric to form loops, a yarn jerker bar reciprocably moving with the needles, yarn guide means comprising:

(a) a yarn tube bank including a plurality of yarn guide tubes having upper and lower open ends, (b) mounting means supporting said yarn tube bank on the machine above the base fabric, (c) said yarn tube bank comprising a yarn jerker member spanning the lower ends of said yarn guide tubes, (d) each of said yarn guide tubes receiving a yarn from a yarn supply through its upper end and guiding said yarn through said corresponding yarn guide tube, and across said yarn jerker member and the yarn jerker bar to a corresponding needle, and (e) adjustment means for vertically adjusting the position of said yarn jerker member on said machine relative to said needles.

2. The invention according to claim 1 in which said adjustment means is cooperative with said mounting means.

3. The invention according to claim 1 in which said adjustment means is adapted to vertically adjust the position of said yarn tube bank on said machine above said needles.

4. The invention according to claim 1 in which said yarn jerker member comprises a stationary transverse yarn jerker rod mounted transversely of the lower ends of said yarn guide tubes, said yarn jerker rod guiding said yarns from said guide tubes to said yarn jerker bar.

5. The invention according to claim 4 further comprising transversely spaced yarn slots in said stationary jerker rod, each slot being in alignment with, and adapted to guide a yarn from, the lower open end of each yarn guide tube.

6. The invention according to claim 1 in which said yarn jerker member comprises an edge of each lower open end of said yarn guide tubes.

7. The invention according to claim 1 in which said mounting means supports said yarn tube bank on the machine behind the needles.

8. The invention according to claim 7 further comprising a needle bar supporting the plurality of transversely spaced needles, the transverse yarn jerker bar being fixed to said needle bar, said yarn jerker member being spaced behind said yarn jerker bar sufficiently to accumulate slack in the yarns passing between said yarn jerker member and said yarn jerker bar to furnish a predetermined length of yarn to a corresponding needle for forming corresponding tufted loops in the base fabric.

9. The invention according to claim 1 further comprising yarn feed means mounted above the upper ends of said yarn guide tubes for positively feeding the yarn from the yarn supply through the open upper ends of said yarn guide tubes.

* * * * *